US006050679A

United States Patent [19]

Howkins

[11] Patent Number: 6,050,679

[45] Date of Patent: Apr. 18, 2000

[54] INK JET PRINTER TRANSDUCER ARRAY WITH STACKED OR SINGLE FLAT PLATE ELEMENT

[75] Inventor: Stuart David Howkins, Ridgefield, Conn.

[73] Assignee: Hitachi Koki Imaging Solutions, Inc., Simi Valley, Calif.

[21] Appl. No.: 08/600,470

[22] Filed: Feb. 13, 1996

Related U.S. Application Data

[63] Continuation of application No. 07/937,077, Aug. 27, 1992, abandoned.

[51] Int. Cl.[7] ..... B41J 2/045

[52] U.S. Cl. ..... 347/72; 347/70

[58] Field of Search ..... 347/68–72; 310/328, 310/365, 366

[56] References Cited

U.S. PATENT DOCUMENTS

| | | | |
|---|---|---|---|
| 2,512,743 | 6/1950 | Hansell | 346/140 R |
| 3,151,543 | 10/1964 | Preisinger | 101/93 |
| 3,215,078 | 11/1965 | Stec | 417/322 |
| 3,452,360 | 6/1969 | Williamson | 346/140 R |

(List continued on next page.)

FOREIGN PATENT DOCUMENTS

| | | | |
|---|---|---|---|
| 0095911 | 12/1983 | European Pat. Off. | B41J 2/045 |
| 0178887 | 4/1986 | European Pat. Off. | B41J 2/045 |
| 3630206 | 3/1987 | Germany | B41J 2/045 |
| 54-146347 | 9/1979 | Japan | B41J 2/045 |
| 56-120365 | 9/1981 | Japan . | |
| 63-92745 | 6/1988 | Japan | B41J 2/045 |
| 52213 | 8/1992 | Japan | B41J 2/045 |

OTHER PUBLICATIONS

*Laminated piezoelectric ceramic transducers*, Electronic Engineering, Apr. 1975.

Description of U.S. Patent No. 4,011,474 (date unknown).

*Piezomotors—Electromechanical Muscle*, C. G. O'Neill, D. S. Randall and P. C. Smiley, Society of Automotive Engineers 1980.

Print heads, excerpts from Derwent, Computer Peripheral Equipment, Aug. 19, 1992.

*Sonics*, Hueter & Bolt. Wiley (1955).

Soviet Physics—Acoustics, *Pulsed Excitation of Transducers*, vol. 15, No. 1, Jul.–Sep. 1969.

*High–Speed Droplet Generator*, H. C. Lee, J. H. Meier and J. W. Raider. IBM Technical Disclosure Bulletin, vol. 15, No. 3, Aug. 1972.

*Ink on Demand Using Silicon Nozzles*, J. M. Brownlow and R. Lane, IBM Technical Disclosure Bulletin, vol. 19, No. 6, Nov. 1976.

(List continued on next page.)

*Primary Examiner*—John Barlow
*Assistant Examiner*—C. Dickens
*Attorney, Agent, or Firm*—Pillsbury Madison & Sutro LLP

[57] ABSTRACT

Transducer arrays for use in multi-jet, drop-on-demand ink jet printers are formed of one or more thin plate-shaped layers of piezoelectric material. Electrodes are electrically coupled to the opposite facing flat plate surfaces of each layer, so as to provide an electric field in the direction orthogonal to the flat plate surfaces. The electric field causes the layer(s) of piezoelectric material to selectively contract or expand in the direction of the electric field. The selective expansion and contraction of the transducer is communicated, through a foot, to selectively contract and expand the volume of an ink-jet chamber. Contraction of the ink-jet chamber causes ink to be expelled through an orifice provided in communication with the ink-jet chamber. A plurality of transducers are arranged in a linear array corresponding to a linear array of ink-jet chambers and orifices. Each foot is elongated in a direction transverse to the direction of the linear array, so as to increase the amount of expansion and contraction of the volume of the ink-jet chamber per unit length of expansion or contraction of the transducer associated with the foot.

41 Claims, 4 Drawing Sheets

U.S. PATENT DOCUMENTS

| | | | |
|---|---|---|---|
| 3,546,498 | 12/1970 | McMaster et al. | 310/8.2 |
| 3,683,212 | 8/1972 | Zoltan | 346/140 R |
| 3,683,396 | 8/1972 | Keur et al. | 346/1.1 |
| 3,708,118 | 1/1973 | Keur | 239/1 |
| 3,828,357 | 8/1974 | Koeblitz | 346/140 R |
| 3,831,727 | 8/1974 | Kruspe et al. | 346/75 |
| 3,848,118 | 11/1974 | Rittberg | 239/101 |
| 3,900,162 | 8/1975 | Titus et al. | 239/102 |
| 3,940,773 | 2/1976 | Mizoguchi et al. | 346/140 R |
| 3,946,398 | 3/1976 | Kyser et al. | 346/1.1 |
| 3,988,745 | 10/1976 | Sultan | 346/140 R |
| 4,005,435 | 1/1977 | Lundquist et al. | 346/1.1 |
| 4,011,474 | 3/1977 | O'Neill | 310/328 |
| 4,021,818 | 5/1977 | Van Vloten | 346/140 R |
| 4,024,544 | 5/1977 | Vernon | 346/1.1 |
| 4,032,929 | 6/1977 | Fischbeck et al. | 346/140 R |
| 4,045,801 | 8/1977 | Iwasaki | 346/140 R |
| 4,046,073 | 9/1977 | Mitchell et al. | 101/426 |
| 4,057,807 | 11/1977 | Fischbeck et al. | 346/140 R |
| 4,068,144 | 1/1978 | Toye | 310/327 |
| 4,068,241 | 1/1978 | Yamada | 346/75 |
| 4,072,959 | 2/1978 | Elmqvist | 346/140 R |
| 4,104,646 | 8/1978 | Fischbeck | 346/140 R |
| 4,112,433 | 9/1978 | Vernon | 346/1.1 |
| 4,115,036 | 9/1978 | Paterson | 417/322 |
| 4,115,789 | 9/1978 | Fischbeck | 346/140 R |
| 4,126,867 | 11/1978 | Stevenson, Jr. | 346/140 R |
| 4,131,899 | 12/1978 | Christou | 346/140 R |
| 4,149,172 | 4/1979 | Heinzl et al. | 346/140 R |
| 4,158,847 | 6/1979 | Heinzl et al. | 346/140 R |
| 4,184,168 | 1/1980 | Isayama et al. | 346/140 R |
| 4,229,751 | 10/1980 | Tamai | 346/140 R |
| 4,266,232 | 5/1981 | Juliana, Jr. et al. | 346/140 R |
| 4,272,200 | 6/1981 | Hehl | 400/124 |
| 4,282,532 | 8/1981 | Markham | 346/75 |
| 4,290,074 | 9/1981 | Royer | 346/75 |
| 4,291,316 | 9/1981 | Kakeno et al. | 346/140 R |
| 4,296,417 | 10/1981 | Markham et al. | 346/75 |
| 4,308,547 | 12/1981 | Lovelady et al. | 346/140 R |
| 4,312,007 | 1/1982 | Winfield | 346/140 R |
| 4,362,407 | 12/1982 | Kolm et al. | 400/124 |
| 4,367,478 | 1/1983 | Larsson | 346/140 R |
| 4,383,264 | 5/1983 | Lewis | 346/140 R |
| 4,389,657 | 6/1983 | McMahon | 346/140 R |
| 4,392,145 | 7/1983 | Parkola | 346/140 R |
| 4,393,384 | 7/1983 | Kyser | 346/1.1 |
| 4,418,355 | 11/1983 | DeYoung et al. | 346/140 R |
| 4,424,520 | 1/1984 | Matsuda et al. | 346/140 R |
| 4,439,780 | 3/1984 | DeYoung et al. | 346/140 R |
| 4,459,601 | 7/1984 | Howkins | 346/140 R |
| 4,468,680 | 8/1984 | Martner | 346/140 R |
| 4,471,363 | 9/1984 | Hanaoka | 346/140 R |
| 4,523,121 | 6/1985 | Takahashi | 310/365 X |
| 4,523,200 | 6/1985 | Howkins | 346/1.1 |
| 4,536,097 | 8/1985 | Nilsson | 400/126 |
| 4,549,191 | 10/1985 | Fukuchi et al. | 346/140 R |
| 4,703,215 | 10/1987 | Asano | 310/328 |
| 4,751,774 | 6/1988 | DeYoung et al. | 29/25.35 |
| 4,752,789 | 6/1988 | Maltsev | 346/140 R |
| 4,759,107 | 7/1988 | Ogawa et al. | 29/25.35 |
| 4,768,266 | 9/1988 | DeYoung | 29/25.35 |
| 4,779,099 | 10/1988 | Lewis | 346/1.1 |
| 4,791,439 | 12/1988 | Guiles | 346/140 R |
| 4,812,698 | 3/1989 | Chida et al. | 310/330 |
| 4,819,014 | 4/1989 | Yasuhara et al. | 346/140 R |
| 4,845,399 | 7/1989 | Yasuda et al. | 310/366 |
| 4,897,903 | 2/1990 | Johannsen | 29/25.35 |
| 4,937,597 | 6/1990 | Yasuhara et al. | 346/140 R |
| 4,978,881 | 12/1990 | Wakita et al. | 310/328 |
| 5,089,739 | 2/1992 | Takasashi et al. | 310/328 |
| 5,126,618 | 6/1992 | Takahashi et al. | 310/346 |
| 5,128,694 | 7/1992 | Kanayama | 346/140 R |
| 5,381,171 | 1/1995 | Hosono et al. | 347/72 |

OTHER PUBLICATIONS

*Modular Drop–on–Demand Ink Jet Printing Head*, M. Anschel, W. W. Hildenbrand, M. Levanoni and S. A. Manning, IBM Technical Disclosure Bulletin, vol. 20, No. 12, May 1978.

*Laminated Ink Jet Head*, F. Lee, R. Mills and F. Talke, IBM Technical Disclosure Bulletin, vol. 23, No. 7A, Dec. 1980.

*A Two–Dimensional Theory for Piezoelectric Layers Used in Electro–Mechanical Transducers–I*, N. Bugdayci and D. B. Bogy, Dept. of Mechanical Engineering, University of California, Berkley, California, 1981.

*The Piezoelectric Capillary Injector—A New Hydrodynamic Method for Dot Pattern Generation*, Erik Stemme and Stig–Goran Larsson, IEEE Transactions on Electron Devices, vol. ED–20, No. 1, Jan. 1973.

INK JET PRINTER TRANSDUCER ARRAY WITH STACKED OR SINGLE FLAT PLATE ELEMENT

This is a continuation of application Ser. No. 07/937,077 filed on Aug. 27, 1992, now abandoned.

BACKGROUND OF THE INVENTION

This invention relates generally to transducer arrays for use in multi-jet, drop-on-demand ink jet printers, the printers which employ such transducer arrays and methods of making and using the same.

In liquid droplet ejecting systems of the drop-on-demand type, also known as impulse ink jet printers, a piezoceramic transducer is used to expel ink as droplets from a small nozzle or jet. An array of such jets is often utilized in high-speed, high-resolution printers where, as is well-known, for a fixed angle of the printer head, the printing rate and printed image resolution is dependent upon the number of jets, spacing therebetween and the droplet emission frequency.

Examples of suitable ink jet printers are described in U.S. Pat. No. 4,459,601, issued Jul. 10, 1984 to Stuart D. Howkins, U.S. Pat. No. 4,714,934 to Rogers, issued Dec. 22, 1987, U.S. Pat. No. 4,768,266 to De Young, issued Sep. 6, 1988, and U.S. Pat. No. 4,751,774 to De Young, et al., issued Jun. 21, 1988, each assigned to the assignee of the present invention and incorporated herein by reference. In those arrangements, an ink jet apparatus of the demand or impulse type comprises a chamber and an orifice from which droplets of ink are ejected in response to the state of energization of a transducer, wherein each transducer is formed of a single elongated strip or rod of piezoceramic material. The transducer communicates with the chamber through a foot forming a movable wall. The transducer expands and contracts in a direction having at least one component extending parallel with the direction of droplet ejection through the orifice, and is expanded in such direction in response to an electric field. The electric field results from an energizing voltage applied transverse to the axis of elongation. The amount of voltage required for a given transducer displacement (expansion or contraction) is dependant on the length of the elongated strip of piezoceramic material. However, longer strips tend to have lower resonant frequencies, which limits the maximum obtainable drop rate or frequency. In addition, lower resonant frequencies are more difficult to dampen.

One problem common to high-speed, high resolution, drop-on-demand ink jet printers occurs because the jets of an array are spaced very close to one another. That is, the response of one jet in an array to its drive voltage can be affected by the simultaneous application of a drive voltage to another nearby jet. This can result in a phenomenon, known in the art as "mechanical cross-talk", where pressure waves are transmitted through the solid material in which the jets are formed, or another phenomenon, known in the art as "electrical cross-talk", where relatively large drive voltages necessary for substantial displacement of transducers utilized in the prior art cause the subsequent pulsing of an inappropriate jet. This is primarily caused by the electrical impedance of the transducer, which tends to be relatively high in transducer designs employing a single elongated strip or rod of piezoceramic material.

One approach to address the problem of mechanical cross-talk is discussed in U.S. Pat. No. 4,439,780, issued Mar. 27, 1984 to De Young, et al. and assigned to the assignee of the present invention and incorporated herein by reference. In that arrangement, an ink jet array comprises a plurality of elongated rod transducers coupled to a plurality of ink jet chambers through a diaphragm. The transducers are supported only at their longitudinal extremities. The support at the extremity remote from the chamber is provided such that no longitudinal motion along the axis of elongation of the transducers occurs, while the support at the other extremity includes bearings which substantially preclude lateral movement of the transducers transverse to their axis of elongation but permit the longitudinal movement thereof along the axis, thus minimizing mechanical cross-talk between jets within the array.

Other characteristic problems which are encountered in the implementation of high-speed, high-resolution impulse ink jet printers do not impact so much upon their operation, but indeed impact upon their fabrications. For example, the relatively small sizes of transducer elements used in densely packed arrays make them difficult to handle.

One approach towards the resolution of the above-described problems is described in U.S. Pat. No. 5,128,694 to Kanayama. As discussed therein, a head for an ink-jet printer includes a piezoelectric transducer formed of a laminated structure in which a plurality of layers of piezoelectric material and a plurality of layers of electrodes are stacked and laminated together in the shape of a rectangular block. Parallel slits extend through four of the nine stacked layers of piezoelectric material, forming two "pressure portions" provided in communication with two ink-jet chambers 18*a* and 18*b* through a plate 12. The two "pressure portions" are connected together by a stack of five layers of piezoelectric material. European Patent Application Publication No. 402,172 to Kubota describes a similar arrangement. Since each of these transducer arrangements employ a layer or several layers of piezoelectric material to interconnect plural layered fingers, it is believed that a significant amount of mechanical cross-talk will occur between the plural layered fingers through the interconnecting piezoelectric layer.

SUMMARY OF THE DISCLOSURE

This invention relates generally to transducer arrays for use in multi-jet, drop-on-demand ink-jet printers, printers which use such transducer arrays and methods of making and using the same. In accordance with a preferred embodiment, a transducer is formed of a thin plate-shaped layered structure comprising one or more thin plate layers of piezoelectric material. Electrodes are electrically coupled to the opposite facing flat plate surfaces of each layer, so as to provide an electric field in the direction orthogonal to the flat plate surfaces. The electric field causes the layer(s) of piezoelectric material to selectively contract or expand in the direction of the electric field. The selective expansion and contraction of the transducer is communicated, through a foot, to selectively contract and expand the volume of an ink-jet chamber. Contraction of the ink-jet chamber causes ink to be expelled through an orifice provided in communication with the ink-jet chamber.

Embodiments of the invention employ a plurality of transducers arranged in a linear array corresponding to a linear array of ink-jet chambers and orifices. Each foot is elongated in a direction transverse to the direction of the linear array, so as to increase the amount of expansion and contraction of the ink-jet chamber per unit length of expansion or contraction of the transducer associated with the foot.

Other objects, advantages and novel features of this invention will become apparent from the following detailed description of a preferred embodiment when considered in conjunction with the accompanying drawings.

BRIEF DESCRIPTION OF THE DRAWINGS

The detailed description will be made with reference to the accompanying drawings, wherein like numerals designate corresponding parts in the several Figures.

DETAILED DESCRIPTION OF PREFERRED EMBODIMENTS

The following detailed description is of the best presently contemplated mode of carrying out the invention. This description is not to be taken in a limiting sense, but is made merely for the purpose of illustrating general principles of embodiments of the invention. The scope of the invention is best defined by the appended claims.

Figure 1:
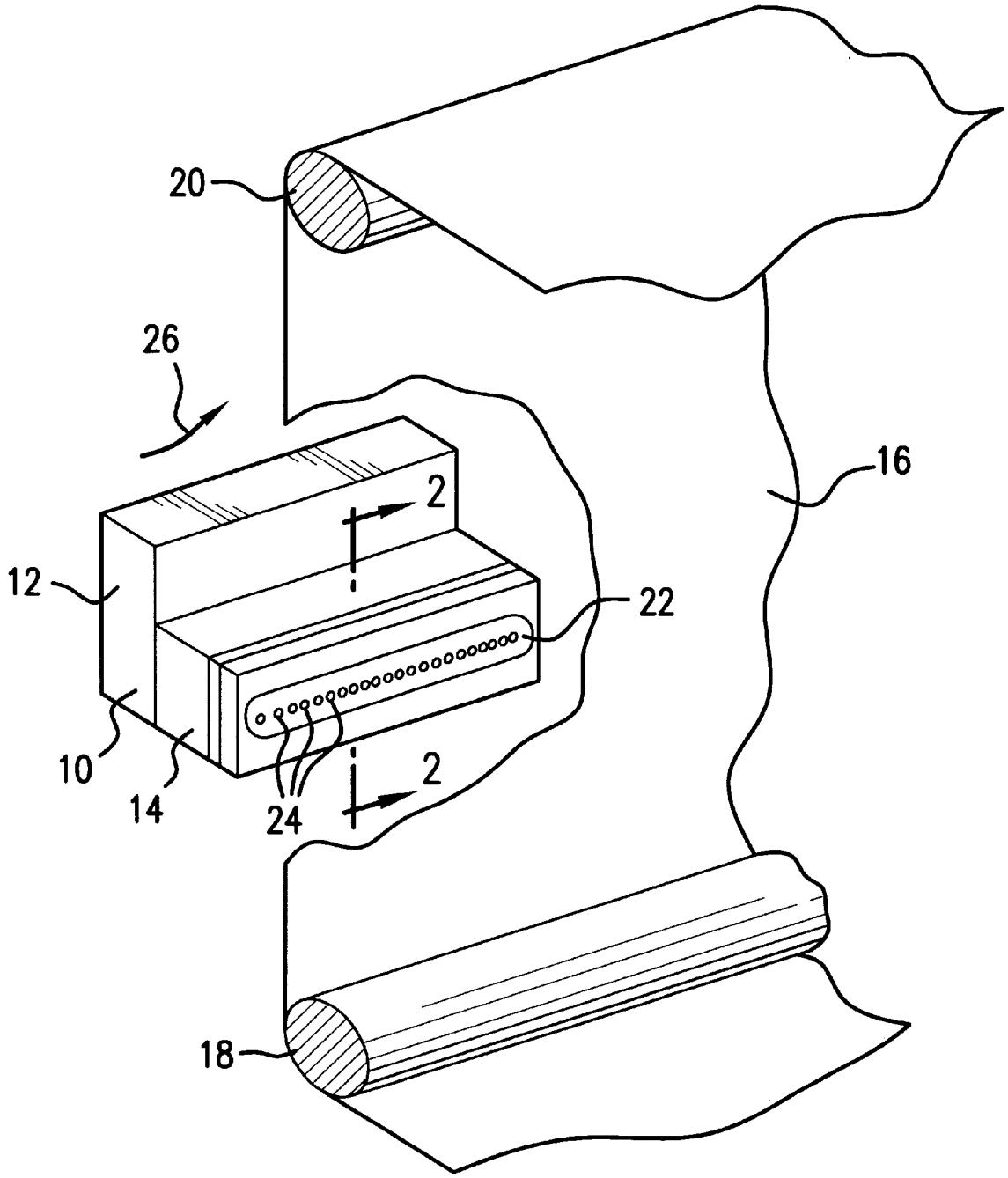
FIG. 1 is a perspective view of a portion of an ink-jet printer.

Referring to FIG. 1, a print head 10 includes a reservoir 12 and an imaging head 14. The print head 10 is juxtaposed to a target in the form of paper 16. The paper is disposed about a paper transport system, including rollers 18 and 20, so as to be advanced in an incremental fashion. As shown in FIG. 1, print head 10 includes an orifice plate 22, including orifices 24, serving as ink-jet nozzles. In FIG. 1, the orifices are arranged at an angle with respect to the scanning direction 26 of the print head 10. The orifices 24 in FIG. 1 are shown further apart from each other than they are in practice for purposes of illustration. In one preferred embodiment, the orifices are formed relatively small. Smaller orifices expel smaller ink droplets, requiring a lower drive voltage. Such smaller orifices can be made, for example, with a thin film electroforming process using small photo-resist buttons.

In the illustrated embodiment, one orifice 24 is provided for each ink jet chamber, as discussed below. However, it will be understood that further embodiments may employ a vertical, horizontal or angled array of plural orifices per ink jet chamber.

Figure 2:
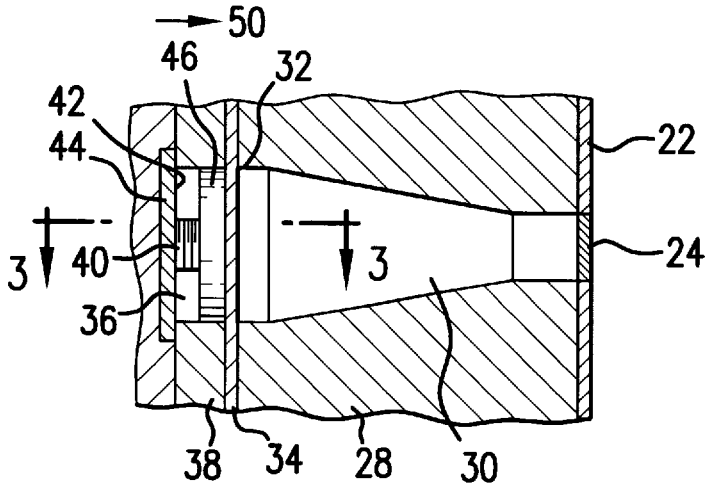
FIG. 2. is a cross-section view of a portion of an ink-jet head in accordance with an embodiment of the invention.
Figure 3:
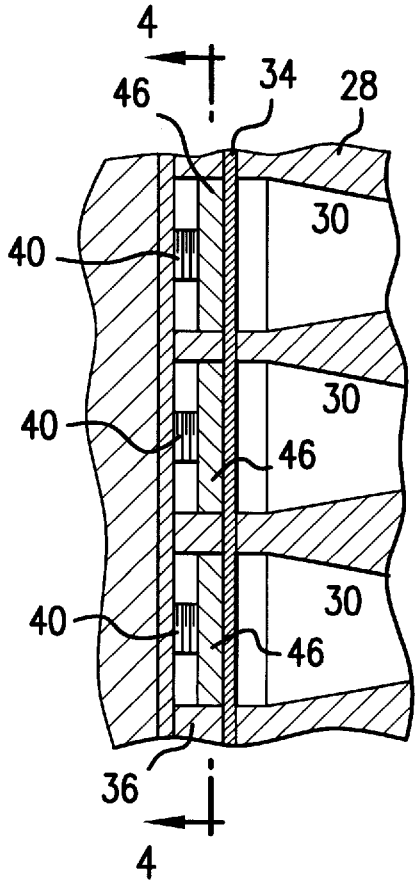
FIG. 3 is a further cross-section view of the ink-jet head of FIG. 2.

As shown in FIGS. 2 and 3, orifice plate 22 is secured to a chamber plate 28. The chamber plate includes a plurality of separate ink jet chambers 30. Ink is communicated to the chambers 30 through passageways 32. Each ink jet chamber 30 has a forward end (the right side of FIGS. 2 and 3) in communication with an orifice 24 in the orifice plate 22. The rearward end of each ink jet chamber 30 (the end to the left side of FIGS. 2 and 3) is closed by a diaphragm plate 34. According to the illustrated embodiment, a single diaphragm plate is shared by a plurality of ink jet chambers. However, further embodiments may include a separate diaphragms for each individual ink jet chamber.

The diaphragm plate 34 separates each ink jet chamber from a respective transducer chamber 36 in a transducer chamber plate 38. A layered array of stacked plates of piezoelectric material forming a transducer 40 is provided between a surface 42 of a support plate 44 and a foot 46, in each transducer chamber 36. The feet 46 may be secured to the transducer plate 38 by a resilient rubber-like material, such as silicone. The ends of the transducers 40 may be cemented to the feet 46 by a suitable adhesive, such as an epoxy.

Each transducer 40 comprises a relatively thin laminated structure, formed of a stack of flat plates or layers 52 of piezoelectric material. By selectively applying a voltage across the planar plate surfaces of each flat plate, the transducer is selectively expanded and contracted in the direction traversing the planar surfaces of the plates. Expansion of the transducer causes the foot 46 to push the diaphragm plate 34 toward the interior of the chamber 30, effecting a reduction in the volume of the chamber. In a reverse manner, contraction of the transducer effects an expansion of the volume of the chamber 30, with respect to the chamber volume when the transducer is expanded.

Application of a voltage across the plates of a transducer 40 causes the transducer to contract (resulting in the expansion of the ink jet chamber) and allows the ink chamber 30 associated with the transducer to fill with ink communicated into the chamber through the passageway 32. Terminating the voltage causes the transducer to expand in the direction of arrow 50, which causes the foot 46 to move the diaphragm 34. This causes a drop of ink to be expelled from the ink jet chamber 30, through the orifice 24.

Figure 4:
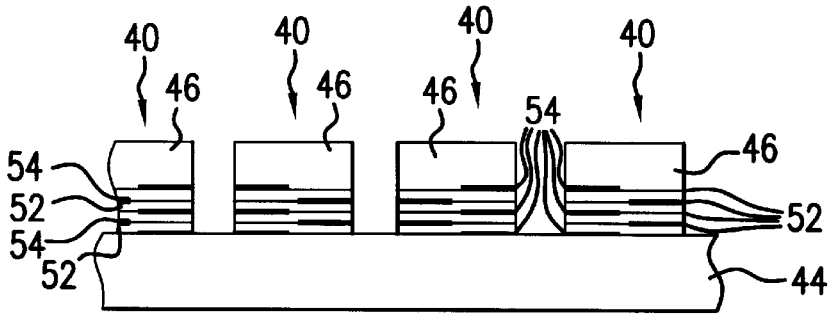
FIG. 4 is a side view of an array of transducers in accordance with one embodiment of the invention.

FIG. 4 shows a side view of three layered transducers 40 provided in a linear array. Each layered transducer includes a stack of four layers 52 of piezoelectric material. An electrode layer 54 is provided between each adjacent pair of layers 52 and at each end of the stack for applying a voltage across the two oppositely facing planar surfaces of each layer 52.

In the embodiment illustrated in FIG. 4, the electrode layers 54 extend only partially across the length of each layer 52 in the direction of the linear array of transducers. As discussed below, with this preferred arrangement, electrical connections to the electrode layers 54 can be simplified. However, it will be understood that further embodiments may employ electrode layers which are co-extensive with, or otherwise suitably connected with, the planar surfaces of the piezoelectric material layers.

The layered transducers 40 in FIG. 4 are supported on one end by a plate 44 of non-piezoelectric material. The opposite end of each transducer 40 abuts a foot 46. In preferred embodiments, the plate 44 is made of a relatively stiff material, such as stainless steel or a stiff composite material.

As discussed above, the illustrated embodiment shows a stack of four layers 52 of piezoelectric material for each transducer 40. However, it will be understood that further embodiments of the invention may employ more or less layers 52 for each transducer 40, including an embodiment wherein each transducer 40 includes no more than one layer 52. Generally, the fewer the number of layers 52, the lower the cost of the transducer 40. However, generally, the larger the number of layers 52, the lower the drive voltage across each layer 52 for a given amount of transducer displacement. Thus, while a transducer 40 having one layer 52 may require a voltage of X Volts applied across each layer to provide a desired displacement, a transducer having N layers 52 would require a voltage of X/N Volts applied across each layer 52 to provide the same displacement. Accordingly, transducers 40 having a larger number of layers 52 may be used in systems wherein a lower drive voltage or a greater displacement is desired.

As compared to the elongated transducers described in the "background of the invention" section herein, the length (in the expanding and contracting direction) of the above described stacked plate (or single plate) transducers 40 can be relatively small. The small length of the transducers 40 can provide further benefits. For example, high frequency jetting and improvements in controlling mechanical cross-talk can be attained with such transducers. High frequency motion and transducer resonance is more quickly damped with smaller length transducers. Moreover, frequencies far above the mechanical or fluidic resonances in the ink-jet apparatus may be used with such small length transducers, to inhibit mechanical cross-talk. Furthermore, high frequency operation requires very short electrical drive pulses, which are more readily generated than longer sustained drive signals, especially at higher voltages.

The ability to decrease the transducer length by using fewer plates or layers 52 and/or thinner layers 52 is limited by the electric field break-down limit of the piezoelectric material. While certain embodiments may employ layers 52 having heights of as small as 1 nil or smaller, the height of each layer may be larger in light of the break-down limit of the piezoelectric material. For example, in one embodiment, transducers having the layer dimensions of 20 mils×40 mils and lengths of 5 mils are used. Accordingly, the length of the transducer 40 can be far shorter than the other dimensions of the transducer, resulting in a flat plate-shaped transducer. Such flat plate-shaped transducers can be more economically manufactured with a greater reproduceability, as discussed below, require less piezoelectric material and tend to be more readily handled and assembled in an ink-jet head than their elongated rod transducer counterparts discussed in the "background of the invention" herein.

In particular, a plurality of flat plate-shaped transducers can be secured to a single support plate 44 (as shown in FIG. 4) which can be mounted, as a single unit, in the ink-jet head. In addition, the flat plate-shaped transducers avoid the alignment and centering problems associated with the elongated rod transducers. Furthermore the flat plate-shaped transducers supported by a support plate 44 tend to be easier to handle and more difficult to break than their elongated rod transducer counterparts.

Thin plates 52 are not only preferred from the standpoint of providing an overall smaller length transducer, but such thin plates tend to provide benefits in the area of reducing electrical cross-talk. In general, the capacitance across a layer 52 (and, thus, the electrical impedance) is at least partially dependent upon the thickness of a layer 52. By making the layer 52 thinner, the capacitance across the layer is increased and the electrical impedance is reduced, resulting in a better ability to inhibit electrical cross-talk.

Figure 5:
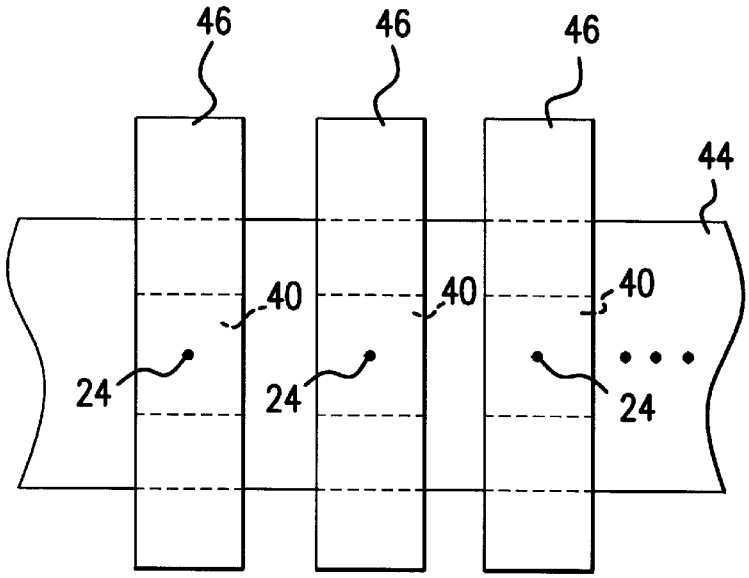
FIG. 5 is a top view of the array of transducers shown in FIG. 4.

In further preferred embodiments, the foot 46 for each transducer 40 is elongated in the direction traverse to the direction of the linear array of transducers 40, as shown in FIG. 5. The elongated foot 46 abuts a greater surface area of the diaphragm 34 than would a non-elongated foot, without effecting the center-to-center distance between adjacent transducers. As a result, the elongated foot effects a larger contraction or expansion in volume of the chamber 30 per unit of expansion or contraction of the transducer 40, than would a non-elongated foot. In addition, the elongated foot 46 can provide further damping capabilities, for further improvements in suppressing mechanical cross-talk between transducers.

Figure 6:
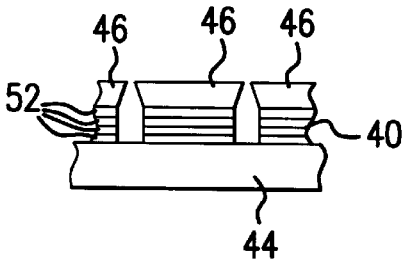
FIG. 6 is a schematic view of an arrangement of transducers and feet according to a further embodiment of the invention.

In the FIG. 5 embodiment, the elongated feet 46 are rectangular shaped and extend, in the elongated direction, perpendicular to the linear array of transducers 40. Each elongated foot 46 may have a width (in the horizontal direction in FIG. 5) substantially equal to, or slightly larger than, the width of the plate(s) 48 of the transducers 40. In this regard, the foot width would have little or no affect on the center-to-center spacing of adjacent transducers 40 in the linear array of transducers or on the center-to-center spacing of adjacent orifices 24. In further embodiments, each foot may be provided with a tapered cross-section, as shown in FIG. 6. In this manner, the foot surface area in contact with the diaphragm is enlarged with respect to the surface area in contact with the transducer 40. This effects a greater change in the volume of chamber 30 per unit of linear displacement (expansion or contraction) of the transducer 40. The tapered foot design effects an improved coupling between the transducer stack 40 and the diaphragm and fluid in chamber 30. That is, the foot acts as, in a sense, a mechanical impedance matching device. It acts as a means to match the impedance of the stiff transducer to the impedance provided by the more compliant diaphragm and the fluid in chamber 30. The motion or resonance of the piezoelectric material, subsequent to the actuation of the transducer, can be damped by the fluid in chamber 30, through the foot. This will result in a quicker reduction of resonant motion of the transducer following one actuation, such that the transducer will be available for a subsequent actuation without the adverse affect of resonant motion remaining in the transducer.

Figure 7:
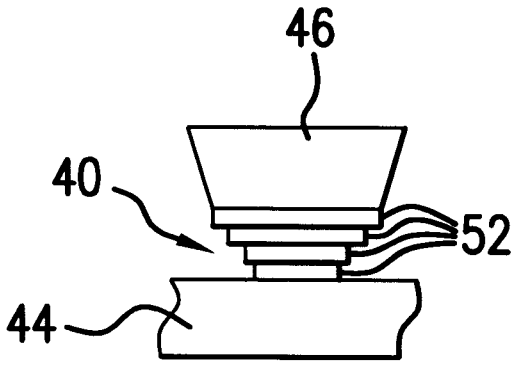
FIG. 7 is a side view of a plurality of transducers manufactured according to an embodiment of the invention.

In a further embodiment, as shown in FIG. 7, each transducer is formed with a tapered cross-section, defining a wider cross-section at the foot end of the transducer than at the support plate end of the transducer. In accordance with this embodiment, the upper (with respect to FIG. 7) layers 52 are cut or formed with a wider (from right to left in FIG. 7) cross-section than the lower layers 52. The tapered walls of the FIG. 7 embodiment tend to make the electrode layers 54 more readily accessible and, therefore, simplifies the step of connecting the electrode layers to a voltage source or to ground. With this embodiment (as well as with at least some of the other embodiments described herein), the foot 46 may be formed as an additional layer on the top-most layer of the stack. Alternatively, the foot may be formed separately from the stack layers.

In accordance with preferred embodiments of the invention, the elongated foot 46 cooperates with the above-described stacked flat plate (or single flat plate) transducer 40. That is, a loss of transducer displacement, resulting from using a small number of flat plates (e.g., for reducing the transducer length for high frequency operation) and/or from reducing the drive voltage, can be compensated for by using an elongated foot to increase the change in volume of a chamber 30 per unit of transducer displacement. Furthermore, by elongating the feet 46 in a direction transverse to the linear array of transducers 40, these benefits are achievable without compromising the transducer packing density, i.e., the close spacing between adjacent transducers in the linear array. The combination of the ability to reduce the transducer length by using fewer thin plates of piezoelectric material (for a more easier damped, high frequency operation) and the enhanced damping ability of the elongated foot 46 provide significant improvements in the ability to minimize mechanical cross-talk between transducers 40.

In accordance with a preferred embodiment, the transducers 40 are manufactured by forming a large plate-shaped slab of one or more layers 52 of piezoelectric material, such as material made from lead titanate zirconate, temporarily bonded to a glass or ceramic plate. Electrodes 54 are formed by photo-chemical techniques, or other suitable techniques, on each layer 52 and on the glass or ceramic plate. In certain embodiments, a foot layer is formed over the stacked layers 52. The layers are bonded together, preferably with a stiff, thin bond layer. One possible bond process involves soldering the layers. Once the layered slab is formed, individual transducers 40 are cut from the slab and the glass or ceramic plate is removed.

As a result, a large number of transducers 40 can be cut from the same slab, thereby reducing the cost and increasing the efficiency of the manufacturing process. Moreover, since the transducers 40 cut from the same slab tend to be similar in electrical and mechanical characteristics, the uniformity of the transducers 40 is improved.

Figure 8:
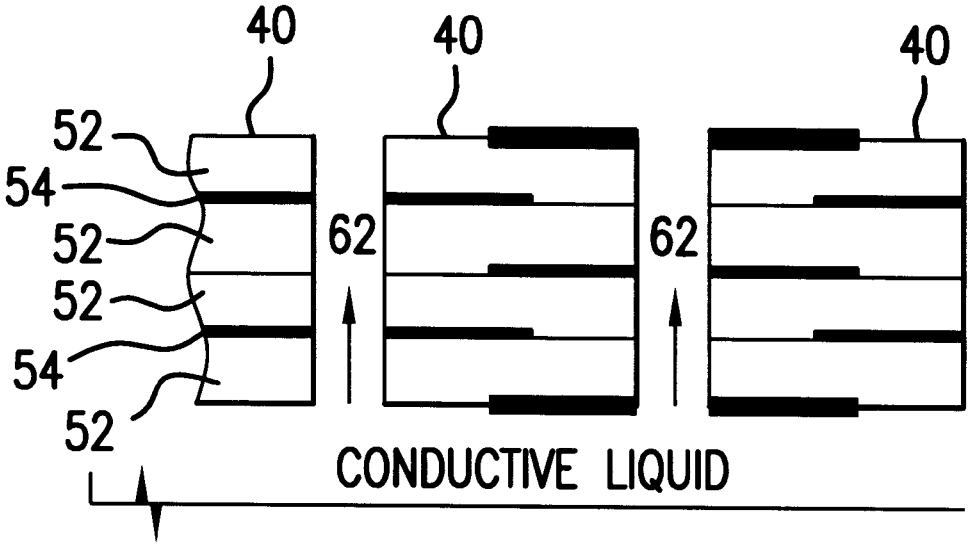
FIG. 8 is a an array of transducers being dipped into a conductive liquid.

Electrical connections for the electrodes can be made in a variety of suitable manners. In one preferred embodiment, as shown in FIG. 8, an array of transducers 40 are dipped into a conductive liquid, such as a volatile solvent with a dispersion of fine silver particles. By capillary action, the conductive liquid will rise up the slots between the transducers, as shown by arrows 62. Once the solvent evaporates, a conductive layer remains along the transducer sides facing the slots, for connecting the electrodes which extend to the slots.

In addition, piezoelectric stacks with electrode connections are available and can be adapted to a transducer array and ink-jet printer system as described herein.

While the above embodiments relate to transducers and print heads, wherein plural transducer units are arranged in a linear array, it will be understood that further embodiments may include two dimensional arrays (e.g., multiple columns and rows) of transducer units.

Various inks may be employed in the method and apparatus of the present invention. For example, it is possible to utilize a "phase change" or "hot melt" ink, such as that described in U.S. Pat. No. (Ser. No. 610,627 filed May 16, 1984) now abandoned, assigned to the assignee of the present invention.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed:

1. A transducer array for an ink-jet printing apparatus, comprising:

a support plate of non-piezoelectric material defining a support surface;

a plurality of transducer units, each of said plurality of transducer units being composed of at least one flat plate-shaped layer of piezoelectric material, the at least one flat plate layer having a first flat plate surface and a second flat plate surface facing opposite the first flat plate surface, the first flat plate surface of a first layer of said piezoelectric material abutting the support surface of the support plate, the second flat plat surface of the at least one layer of said piezoelectric material being electrically coupled to an electrode disposed substantially in parallel with the support surface, and each of the transducer units having a transducer length in a transducer expansion direction from the first flat plate surface of the first layer of said piezoelectric material to the second flat plate surface of a last layer of said piezoelectric material and having a width in a direction transverse to the transducer length, the transducer length being no more than three times the transducer width;

a plurality of transducer chambers, each of said plurality of transducer chambers having a transducer chamber length in the transducer expansion direction, wherein each of the plurality of transducer units is disposed in a corresponding one of the plurality of transducer chambers; and a voltage source electrically coupled to said electrode for applying a voltage across each flat plate surface of the at least one layer of piezoelectric material, wherein upon applying the voltage across each flat plate surface, the at least one layer of piezoelectric material contracts or expands in a direction perpendicular to the flat plate surface.

2. A transducer array as recited in claim 1, wherein each transducer unit comprises a plurality of flat plate-shaped layers of piezoelectric material.

3. A transducer array as recited in claim 1, wherein each electrode comprise a layer of conductive material provided adjacent and parallel to each plate surface of the one or more layers of piezoelectric material.

4. A transducer array as recited in claim 1, wherein:

each transducer unit comprises a plurality of flat plate-shaped layers of piezoelectric material defining a stack, the stack having one surface facing and parallel to the support surface of the support plate and a second oppositely facing surface spaced from the support surface; and the transducer array further comprises an elongated foot coupled to the second surface of the stack of layers of piezoelectric material.

5. A transducer array as recited in claim 1, further comprising an elongated foot coupled to a surface opposite the support plate abutting surface of and extending beyond a width of each of said transducer units.

6. A transducer array as recited in claim 5, wherein each elongated foot is elongated in a direction substantially perpendicular to the the transducer expansion direction.

7. A transducer array as recited in claim 5, wherein the ink-jet printing apparatus for which the transducer array is designed to operate includes a plurality of ink-jet chambers and each of said transducer units and associated foot is configured to be arranged adjacent a respective ink-jet chamber, each foot defines a foot surface facing an adjacent ink-jet chamber, and a chamber facing foot surface of each foot has a surface area designed to provide a substantial impedance match between an associated transducer array and the adjacent ink-jet chamber.

8. A transducer array as recited in claim 5, wherein each foot has a first surface facing the coupled transducer unit and a second foot surface facing away from its associated transducer unit, the foot being tapered between the first and second foot surfaces such that the second foot surface defines a surface area larger than a surface area defined by the first foot surface.

9. A transducer array as recited in claim 1, wherein:

each transducer unit comprises a plurality of flat plate-shaped layers of piezoelectric material stacked one-on-another on the support surface of the support plate: and each of said layers arranged further from the support surface defines a layer surface area which is larger than the layer surface area defined by each layer arranged closer to the support surface in the stack.

10. A transducer array as recited in claim 1, wherein the support plate is substantially flat and the first of the first layer of piezoelectric material of the opposite facing flat plate surfaces abuts the support surface of the support plate independent of lateral support.

11. A transducer array as recited in claim 1, wherein the support plate of non-piezoelectric material is non-conducting.

12. A transducer array as recited in claim 1, wherein the at least one flat plate-shaped layer of piezoelectric material expands for droplet ejection in the transducer expansion direction.

13. A transducer array for an ink-jet printing apparatus, comprising:

a support plate of non-piezoelectric material defining a support surface;

a plurality of transducer units arranged in a first linear array, each of said plurality of transducer units being composed of at least one layer of piezoelectric material defining a stack, the stack having a first surface and a second surface facing opposite the first surface, the first surface of the stack abutting the support surface of the support plate, the at least one layer of piezoelectric material being electrically coupled between a pair of electrodes disposed substantially in parallel with the support surface, and each of the plurality of transducer units having a transducer length in a transducer expansion direction from the first surface of the stack to the second surface of the stack and having a width in a direction transverse to the transducer length, the transducer length being no more than three times the transducer width;

a plurality of transducer chambers, each of the plurality of transducer chambers having a transducer chamber length in the transducer expansion direction, wherein each of the plurality of transducer units is disposed in a corresponding one of the plurality of transducer chambers;

a plurality of elongated feet corresponding in number to the plurality of transducer units, each of the plurality of elongated feet being associated with a respective one of the plurality of transducer units and being coupled to the second surface of the stack of the respective one of the transducer units, each of the plurality of elongated feet being elongated in a direction transverse to the first linear array of transducers; and a voltage source electrically coupled to the pair of electrodes for applying a voltage across the at least one layer of said piezoelectric material, wherein upon applying the voltage across the at least one layer of said piezoelectric material, the at least one layer of said piezoelectric material contracts or expands in the direction perpendicular to the first and second opposite facing surfaces thereof.

14. A transducer array as recited in claim 13, wherein each transducer unit comprises a plurality of layers of piezoelectric material.

15. A transducer array as recited in claim 13, wherein each elongated foot is elongated in a direction substantially perpendicular to the the transducer expansion direction.

16. A transducer array as recited in claim 13, wherein the ink-jet printing apparatus for which the transducer array is designed to operate includes a plurality of ink-jet chambers and each of said transducer units and associated foot is configured to be arranged adjacent a respective ink-jet chamber, each foot defines a foot surface facing the adjacent ink-jet chamber, and the chamber facing foot surface of each foot has a surface area designed to provide a substantial impedance match between the associated transducer array and the adjacent ink-jet chamber.

17. A transducer array as recited in claim 13, wherein each stack has a plurality of layers of piezoelectric material stacked one-on-another on the support surface of the support plate, wherein each of said layers arranged further from the support surface defines a layer surface area which is larger than a layer surface area defined by each of said layers arranged closer to the support surface in the stack.

18. A transducer array as recited in claim 13, wherein each foot has a first foot surface facing the associated transducer unit and a second foot surface facing away from the associated transducer unit, the foot being tapered between the first foot surface and the second foot surface such that the second foot surface defines a surface area larger than a surface area defined by the first foot surface.

19. An ink-jet apparatus comprising:

a plurality of ink-jet chambers arranged in a linear array;

a support plate of non-piezoelectric material defining a support surface;

a plurality of transducer units, each of said plurality of transducer units being associated with a respective ink-jet chamber and being arranged adjacent in said associated ink-jet chamber, each of said transducer units being composed of at least one flat plate-shaped layer of piezoelectric material, the at least one flat plate-shaped layer of piezoelectric material having a first flat plate surface and a second flat plate surface facing opposite the first flat plate surface, the first flat plate surface of a first layer of piezoelectric material abutting the support surface of the support plate, and the second flat plate surface of the at least one flat plate-shaped layer of piezoelectric material being electrically coupled to an electrode disposed substantially in parallel with the support surface, each of the plurality of transducer units having a transducer length in a transducer expansion direction from the first flat plate surface of the first layer of piezoelectric material to the second flat plate surface of a last layer of piezoelectric material and having a width in a direction transverse to the transducer length, the transducer length being no more than three times the transducer width;

a plurality of transducer chambers, each of the plurality of transducer chambers having a transducer chamber length in the transducer expansion direction, wherein each of the plurality of transducer units is disposed in a corresponding one of the plurality of transducer chambers; and drive means for applying a drive signal across the electrodes electrically coupled to the flat plate surfaces of the at least one flat plate-shaped layer of piezoelectric material, wherein the drive signal causes each layer of piezoelectric material to contract or expand in a direction from one to another of said flat plate surfaces.

20. A transducer array for an ink-jet printing apparatus, comprising:

a substantially flat support plate of non-conducting, non-piezoelectric material defining a support surface;

a plurality of transducer units, each of said plurality of transducer units being composed of at least one flat plate-shaped layer of piezoelectric material, the at least one layer of piezoelectric material having a first flat plate surface and second flat plate surface facing opposite the first flat plate surface, the first flat plate of a first layer of piezoelectric material abutting the support surface independent of lateral support, the second flat plate surface of the at least one layer of piezoelectric material being electrically coupled to an electrode disposed substantially in parallel with the support surface, and each of the plurality of transducer units having a transducer length in a transducer expansion direction from the first flat plate surface of the first layer of piezoelectric material to the second flat plate surface of a last layer of piezoelectric material and having a width in a direction transverse to the transducer length, the transducer length being no more than three times the transducer width;

a plurality of transducer chambers, each of the plurality of transducer chambers having a transducer chamber length in the transducer expansion direction, wherein each of the plurality of transducer units is disposed in a corresponding one of the plurality of transducer chambers; and a voltage source electrically coupled to the electrode for applying a voltage across the at least one layer of piezoelectric material, wherein upon applying the voltage across the at least one layer, of piezoelectric material the at least one layer of piezoelectric material contracts or expands in the direction perpendicular to the first and second opposite facing flat plate surfaces.

21. A transducer array for an ink-jet printing apparatus, comprising:

a plurality of transducer units, each of the transducer units being composed of at least one flat plate-shaped layer of piezoelectric material, the at least one layer of piezoelectric material having a first flat plate surface and a second flat plate surface facing opposite the first flat plate surface, the first flat plate surface of a first layer of piezoelectric material being adapted for abutting a support surface comprising a non-piezoelectric material, the second flat plate surface of the at least one piezoelectric layer being electrically coupled to an electrode, and each of the plurality of transducer units having a transducer length in a transducer expansion direction from the first flat plate surface of the first layer of piezoelectric material to the second flat plate surface of a last layer of piezoelectric material and having a width in a direction transverse to the transducer length, the transducer length being no more than three times the transducer width; and a plurality of transducer chambers, each of the plurality of transducer chambers having a transducer chamber length in the transducer expansion direction, wherein each of the plurality of transducer units is disposed in a corresponding one of the plurality of transducer chambers.

22. A transducer array as recited in claim 21, wherein each transducer unit comprises a plurality of flat plate-shaped layers of piezoelectric material.

23. A transducer array as recited in claim 21, wherein:

each transducer unit comprises a plurality of flat layers of piezoelectric material defining a stack; and the transducer array further including an elongated foot coupled to the second surface of the stack of layers of piezoelectric material.

24. A transducer array as recited in claim 21, further comprising an elongated foot coupled to each of the transducer units and extending beyond a width of each of said transducer units.

25. A transducer array as recited in claim 24, wherein each elongated foot is elongated in a direction substantially perpendicular to the first linear array of transducers.

26. A transducer array as recited in claim 24, wherein the ink-jet printing apparatus for which the transducer array is designed to operate includes a plurality of ink-jet chambers and each of said transducer units and associated foot is configured to be arranged adjacent a respective ink-jet chamber, each foot defines a foot surface facing an adjacent ink-jet chamber, and a chamber facing foot surface of each foot has a surface area designed to provide a substantial impedance match between an associated transducer array and the adjacent ink-jet chamber.

27. A transducer array as recited in claim 24, wherein each foot has a first foot surface facing the coupled transducer unit and a second foot surface facing away from its associated transducer unit, the foot being tapered between the first and second foot surfaces such that the second foot surface defines a surface area larger than a surface area defined by the first foot surface.

28. A transducer array as recited in claim 21, wherein:

each transducer unit comprises a plurality of flat layers of piezoelectric material stacked one-on-another; and each layer of piezoelectric material of each transducer unit arranged further from the support surface defines a layer surface area which is larger than the layer surface area defined by each previous layer arranged along the second length between the first and second opposite faces.

29. A transducer array as recited in claim 21, wherein the piezoelectric material of each transducer unit expands for droplet ejection in transducer expansion direction.

30. A transducer any as recited in claim 22, wherein the first and second opposite facing flat plate surfaces of the at least one layer of piezoelectric material is separated by less than about 5 mils.

31. A transducer array as recited in claim 30, wherein the transducer length is selected to increase each transducer's high frequency operation and capacitance such that electrical and mechanical cross-talk is reduced.

32. A transducer array as recited in claim 22, wherein each of the transducer units has a width perpendicular to the transducer length, and wherein the ratio between the width and the transducer is greater than 4:1.

33. A transducer array as recited in claim 22, wherein the transducer length of each transducer unit is selected to increase each transducer's high frequency operation and capacitance such that electrical and mechanical cross-talk is reduced.

34. A transducer array for an ink-jet printing apparatus, comprising:

a plurality of transducer units arranged in a first linear array, each of said transducer units being composed of at least one layer of piezoelectric material defining a stack, the stack having a first surface and a second surface facing opposite the first surface, the at least one layer of piezoelectric material being electrically coupled between a pair of electrodes disposed substantially in parallel with the first and second surfaces, and a distance from the first surface to the second surface of the stack in a transducer expansion direction defining a transducer length and having a width in a direction transverse to the transducer length, the transducer length being no more than three times the transducer width;

a plurality of transducer chambers, each of said plurality of transducer chambers having a transducer chamber length in the transducer expansion direction, wherein each of the plurality of transducer units is disposed in a corresponding one of the plurality of transducer chambers;

a plurality of elongated feet corresponding in number to the plurality of transducer units, each of the plurality of elongated feet being associated with a respective one of the plurality of transducer units and being coupled to a second surface of the stack of the associated one of the plurality of transducer units, each of said plurality of elongated feet being elongated in a direction transverse to the first linear array of transducers; and a voltage source electrically coupled to the electrodes for applying a voltage across the at least one layer of piezoelectric material, wherein upon applying the voltage across the at least one layer of piezoelectric material, the at least one layer of piezoelectric material contracts or expands in the transducer expansion direction.

35. A transducer array as recited in claim 31, wherein each of the transducer units comprises a plurality of layers of piezoelectric material.

36. A transducer array as recited in claim 31, wherein each elongated foot is elongated in a direction substantially perpendicular to the transducer expansion direction.

37. A transducer array as recited in claim 34, wherein the ink-jet printing apparatus for which the transducer array is designed to operate includes a plurality of ink-jet chambers and each transducer unit and associated foot is configured to be arranged adjacent a respective ink-jet chamber, each foot defines a foot surface facing the adjacent ink-jet chamber, and the chamber facing foot surface of each foot has a surface area designed to provide a substantial impedance match between the associated transducer array and the adjacent ink-jet chamber.

38. A transducer array as recited in claim 31, wherein each stack has a plurality of layers of piezoelectic material stacked one-on-another, wherein each of successive layer defines a layer surface area which is larger than a layer surface area defined by each previous layer arranged along the transducer length.

39. A transducer array as recited in claim 34, wherein each foot has a first foot surface facing the associated transducer unit and a second foot surface facing away from the associated transducer unit, the foot being tapered between the first foot surface and the second foot surface such that the second foot surface defines a surface area larger than a surface area defined by the first foot surface.

40. A transducer array as recited in claim 31 wherein between the first and second opposite facing flat plate surfaces the at least one layer of piezoelectric material has a thickness in the transducer expansion direction which is less than about 5 mils.

41. A transducer array as recited in clams 34, wherein each of the transducer units has a width perpendicular to the transducer expansion direction, and wherein the ratio between the width and the transducer length is greater than 4:1.

* * * * *